US005239235A

United States Patent [19]

Mourier

[11] Patent Number: 5,239,235

[45] Date of Patent: * Aug. 24, 1993

[54] MULTIPLE-BEAM MICROWAVE TUBE WITH COAXIAL OUTPUT AND COAXIAL COLLECTOR

[75] Inventor: Georges Mourier, Mareil Sur Mauldre, France

[73] Assignee: Thomson Tubes Electroniques, Boulogne Billancourt, France

[ * ] Notice: The portion of the term of this patent subsequent to Aug. 10, 2010 has been disclaimed.

[21] Appl. No.: 643,751

[22] Filed: Jan. 22, 1991

[30] Foreign Application Priority Data

Feb. 2, 1990 [FR] France ..... 90 01230

[51] Int. Cl.[5] ..... H01J 25/10

[52] U.S. Cl. ..... 315/5.14; 315/5.16; 315/5.39; 315/5.51; 315/5.38

[58] Field of Search ..... 315/5.14, 5.16, 5.39, 315/5.38, 39, 5.51; 330/44.45

[56] References Cited

U.S. PATENT DOCUMENTS 2,408,409 10/1946 Bowen ..... 333/230 X
2,939,028 5/1960 Cook ..... 315/5.16
3,107,313 10/1963 Hechtel ..... 315/5.16
3,114,072 12/1963 Belohoubek ..... 333/157 X
3,248,594 4/1966 Boyd ..... 315/5.14
4,733,131 3/1988 Tron et al. ..... 315/5 X

FOREIGN PATENT DOCUMENTS 1423769 11/1965 France .
662567 12/1951 United Kingdom .

OTHER PUBLICATIONS

Proceedings of Institution of Engineers, vol. 109B, No. 523 1962; "E.F. Belohoubek" pp. 718–722.
International Electron Devices Meeting; Bres et al. Los Angeles; 7–10, Dec. 1986; pp. 784–786.
Electronics vol. 35, No. 13, New York U.S. pp. 72, 73.

*Primary Examiner*—Robert J. Pascal
*Assistant Examiner*—Benny T. Lee
*Attorney, Agent, or Firm*—Roland Plottel

[57] ABSTRACT

Disclosed is a microwave tube with n (where n is an integer greater than one) longitudinal electron beams parallel to an axis XX'. It has at least one output cavity crossed by the electron beams and one collector collecting the n electron beams at their output from the cavity. A transmission line is coupled to the output cavity. The transmission line is coaxial with the axis XX'. The collector is positioned around the transmission line and is coaxial with it. The device can be applied to multiple-beam klystrons capable of working at high power and at high frequency.

15 Claims, 3 Drawing Sheets

Section AA'

Section BB'

MULTIPLE-BEAM MICROWAVE TUBE WITH COAXIAL OUTPUT AND COAXIAL COLLECTOR

BACKGROUND OF THE INVENTION

1. Field of the Invention

The present invention concerns multiple-beam microwave tubes with longitudinal interaction, such as multiple-beam klystrons. In particular, it concerns multiple-beam klystrons with a coaxial output.

2. Description of the Prior Art

A multiple-beam klystron has N parallel longitudinal electron beams produced by one or more electron guns. The fact of splitting of a beam into several elementary beams has the advantage of reducing the space-charge effects and of giving a tube with greater efficiency. This also enables the current and power of the tube to be increased or else its operating voltage to be reduced.

Several standard single-beam klystrons can be grouped together in one and the same envelope: in this way a multiple-beam klystron is obtained. The single-beam klystrons are distributed on a ring centered on an axis. This axis is the axis of the multiple-beam klystron. The different electron beams are then parallel to this axis. This construction enables certain elements of standard single-beam klystrons to be used without any notable modification. The beams produced by each of the klystrons are then elementary beams. They go through successive cavities, each cavity being crossed by all the beams.

A standard single-beam klystron is built around an axis which is the axis of the electron beam. A microwave to be amplified is introduced into the first cavity which is on the gun side. This is the input cavity. The last cavity or output cavity is connected to an external energy-using apparatus by means of a short transmission line. The transmission line is generally positioned crosswise with respect to the axis of the tube. It receives the microwave after amplification. The electron beam is collected in a collector that is coaxial with the axis of the tube. This collector is placed downline of the output cavity. A focusing device surrounds the cavities. It prevents any divergence of the electron beam in the drift tubes and in the cavities.

In a multiple-beam klystron formed by several single-beam klystrons grouped together in one and the same envelope, the focusing device may be common to all the tubes.

The major drawback of the multiple-beam klystrons formed by the grouping together of several single-beam klystrons lies in the output of the microwave energy.

The output cavity is connected to a transmission line. The transmission line is generally lateral and may be placed transversally with respect to the axis of the tube. This construction is then dissymmetrical. The dissymmetry notably causes problems in focusing.

The focusing device cannot totally surround the output cavity connected to the lateral transmission line. The magnetic field is then reduced at this place, and this entails the risk of a disturbance in the path of the electron beams crossing this cavity. It is possible to use coils of electro-magnets cut into the transmission line, but these coils do not really make it possible to recover a proper magnetic field value. It is also possible to use a curved guide.

The dissymmetry arising out of the transmission line which is transversal also entails difficulties in the assembling of the tube. For, the assembly formed by the gun, the cavities and the collector must be slid in and fitted precisely into the focusing device. This task of manipulation is always very difficult to perform because the the mass of the assembly is are very great. The transmission line then has to be connected to the output cavity. This connection has to be very precise.

In French patent application No. 89 07784, filed on 13th June 1989, the present Applicant has already proposed a klystron type microwave tube having an output coaxial with the collector. According to one embodiment, this application describes a multiple-beam klystron built around an axis. This klystron has, chiefly, a gun producing several electron beams, successive cavities and a collector. Each cavity is crossed by all the beams. The collector located downline of the last cavity is coaxial with the axis of the tube. The last cavity is coupled to a transmission line that surrounds the collector and is coaxial with it. This transmission line is, for example, a coaxial waveguide. The coupling between the output cavity and the transmission line is achieved by at least one coupling aperture.

This construction is symmetrical at the output but, nevertheless, has other drawbacks. The collector is surrounded by the transmission line. Its diameter is limited and so are its possibilities of discharging heat. Furthermore, if the collector has to be cooled by the circulation of a liquid, the quantity of liquid that can circulate is restricted. As a consequence, this tube can work only at moderate levels of mean or peak power. By contrast, the transmission line surrounding the collector has large dimensions. If the operating frequency is high, then there is a risk that the transmission line may be oversized. Several modes may then get propagated in the transmission line, and this is not desirable.

SUMMARY OF THE INVENTION

The present invention seeks to overcome these drawbacks and proposes a multiple-beam microwave tube built around a longitudinal axis, capable of working at high power and at high frequency. This tube is connected to a external energy-using microwave circuit by means of a transmission line located in the prolongation of the axis of the tube.

The present invention proposes a microwave tube comprising:

- n (where n is an integer greater than one) longitudinal electron beams parallel to an axis XX';
- successive cavities crossed by the electron beams, one of these cavities, namely an output cavity, ending in a terminal wall that is substantially transversal to the axis XX';
- a transmission line coaxial with the axis XX';
- a collector collecting the n electron beams at their output from the output cavity, surrounding the transmission line and being coaxial with it. The terminal wall has at least one aperture opening into the transmission line to couple the transmission line with the output cavity.

The n electron beams are distributed on a ring.

The diameter of the transmission line is smaller than the internal diameter of the ring.

The transmission line may be a circular waveguide or a coaxial guide. When the transmission line is a coaxial guide, the aperture opens out between the internal conductor and the external conductor of the coaxial guide.

According to one variant, a cavity groups together n adjacent secondary cavities, with each electron beam crossing a secondary cavity.

Each secondary cavity of the output cavity is coupled by at least one aperture to the transmission line.

The apertures are all distributed on a ring centered on the axis XX'.

The secondary cavities may be either electrically insulated from one another or coupled to one another.

According to another variant, the secondary cavities are divided into compartments and they group together several mutually coupled elementary cavities.

In each secondary cavity, only elementary cavity is crossed by an electron beam.

Preferably, the secondary cavities belonging to one and the same cavity are identical and work in their dominant mode. They are excited in phase, with substantially one and the same amplitude.

The invention shall be explained in detail by means of the following description. This description shall be made with reference to the appended drawings.

BRIEF DESCRIPTION OF THE DRAWINGS

Of these drawings.

In the different figures, the same references are repeated for the same elements.

DETAILED DESCRIPTION OF THE INVENTION

Figure 1:
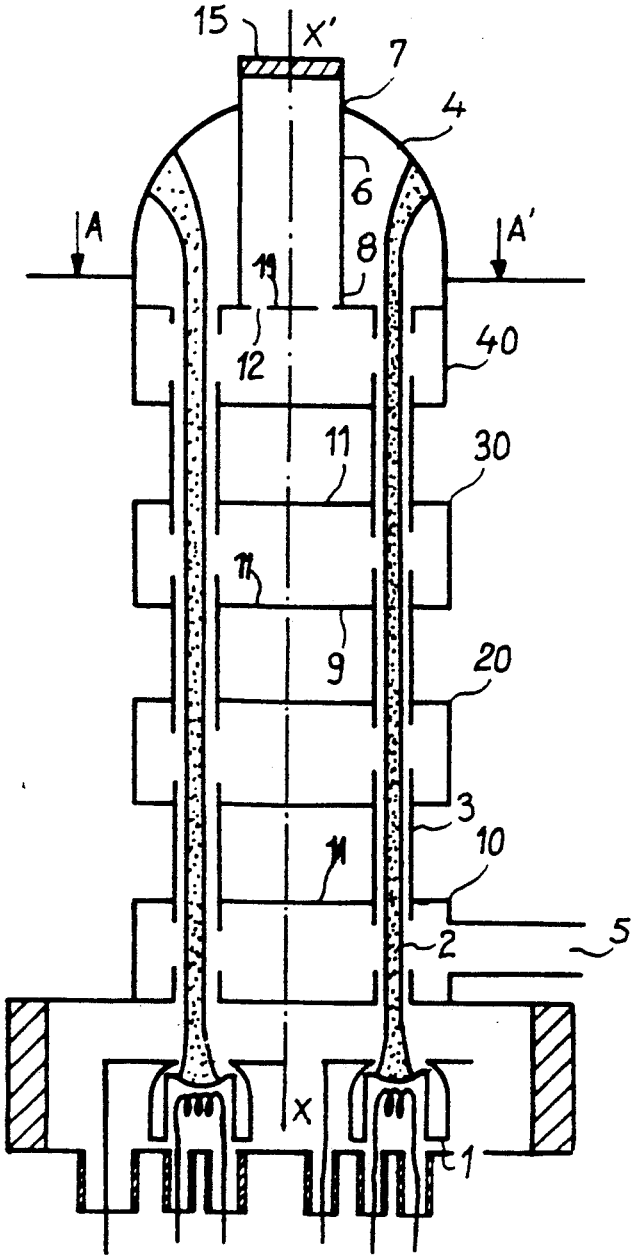
FIG. 1 shows a schematic view, in longitudinal section, of a multiple-beam klystron according to the invention.

The multiple-beam klystron shown in FIGS. 1 and is a klystron with n electron beams 2 where n is an integer greater than one. Here n is equal to six. Each of these electron beams is produced by an electron gun 1 (see FIG. 1). The electron beams 2 are longitudinal and parallel.

The klystron is built around an axis of revolution XX'. The six electron guns 1 are distributed on a ring centered on the axis XX'.

Each electron beam 2 goes through cavities 10, 20, 30, 40, positioned one after the another along the axis XX'(see FIG. 1). Each cavity is crossed by all the beams 2. Two successive cavities are separated by drift tubes 3. These drift tubes 3 contribute to setting up imperviousness between the interior and the exterior of the cavities.

As shown in FIG. 1 cavity 10, which is the cavity closest the electron gun 1, is the input cavity. It receives a microwave to be amplified which gets propagated in the transmission line 5. Here it is a waveguide transversal to the axis XX'. The last cavity 40 or output cavity is connected to a device designed to collect the microwave after amplification.

After they have crossed the output cavity 40, all the electron beams 2 are collected in a single collector 4.

A focusing device (not shown) surrounds the cavities 10, 20, 30, 40.

The invention relates to the lay-out of the output cavity, the collector and the device designed to collect the microwave after amplification.

The cavities 10, 20, 30, 40 have the shape of hollow cylinders closed at both their ends by two walls 9, 11 placed so as to face each other and positioned crosswise with respect to the axis XX'.

Each electron beam 2 penetrates a cavity on the wall 9 side and comes out of it on the wall 11 side. The wall 11 is a terminal wall.

Figure 2:
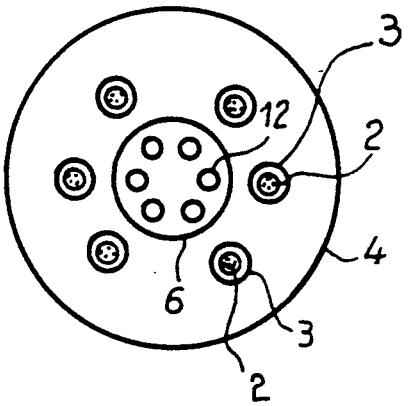
FIG. 2 shows a cross-section, along the axis AA' of FIG. 1, of the same klystron.

The device designed to collect the microwave after amplification is formed by a transmission line 6. This transmission line 6 is extended in the prolongation of the axis XX'. This transmission line 6 is connected by one side to the klystron and by the other side to an energy-using apparatus (not shown). The transmission line 6 is preferably a circular waveguide or a coaxial guide. A coaxial guide includes an internal conductor surrounded by an external conductor. The external conductor is hollow. The internal conductor may be solid or hollow. These two conductors are coaxially mounted cylinders of a shape generated by revolution. The space between the two conductors may be filled with air or with a gas, or it may be under vacuum. The transmission line 6 of the klystron shown in FIGS. 1 and 2 is a circular waveguide. Its axis is the same as the axis XX'. The waveguide 6 has one end 7 connected to the energy-using apparatus. This is its upper end. Its other end 8 is fixedly joined to the klystron. This is its lower end or its base.

The base 8 of the coaxial guide is fixedly joined to the terminal wall 11 of the output cavity 40. The connection between the waveguide 6 and the output cavity 40 should be impervious to prevent leaks of microwave energy towards the exterior of the tube.

The output cavity 40 has at least one coupling aperture 12 which goes through its terminal wall 11 and opens into the interior of the transmission line 6. In FIG. 2 as many coupling apertures 12 as electron beams 2 are shown, and these coupling apertures 12 are positioned on a ring centered on the axis XX' so that they open into the interior of the waveguide 6.

The coupling apertures 12 shown in FIG. 2 are circular. They could have been oblong or could have had any other shape.

Each beam 2 crosses the output cavity 40 from one side to the other, and is collected in a collector 4. This collector 4 surrounds the transmission line 6 and is coaxial with it. The collector 4 has the general shape of a hollow cylinder. It is metallic. It is fixedly joined at its base with the terminal wall 11 of the output cavity 40. Its upper end is closed, and it may rest on the transmission line 6. In FIG. 1, the collector 4 is formed by a dome. The electron beams 2 penetrate the interior of the collector 4 and strike its external wall. The surface area of this external wall will be sufficient to enable effective cooling. Since the collector is placed outside the transmission line 6, its maximum dimensions are not limited.

A circuit enabling the flow of a cooling fluid may be placed inside the collector 4, around the transmission line 6 for example. This construction will be used above all if the klystron works at a high level of mean and/or peak power.

Dimensional constraints appear only for the transmission line 6. It should be possible for the cross-section of the transmission line 6 to go within the ring defined by the electron beams 2. The electron beams should not strike the transmission line 6. The diameter of the circular guide is smaller than the internal diameter of the ring. Furthermore, it is always useful to restrict the dimensions of this cross-section so that there is no addition of any unnecessary higher modes.

Preferably, an impervious microwave window 15 will be placed inside the transmission line 6, before the connection with the energy-using apparatus. This window 15 is designed to maintain a high vacuum within the tube while, at the same time, letting the microwaves pass through towards the energy-using apparatus. Instead of placing the window 15 inside the transmission line 6, it is possible to block each coupling aperture 12 with a window.

If the transmission line 6 is a circular waveguide, this waveguide will preferably work in a $TM_{01}$ mode. This $TM_{01}$ mode is easily coupled with the mode of the cavities because of its axial symmetry.

If the transmission line 6 is a coaxial guide, this coaxial guide will preferably work in TEM mode which is the most commonly used mode.

Figure 4:
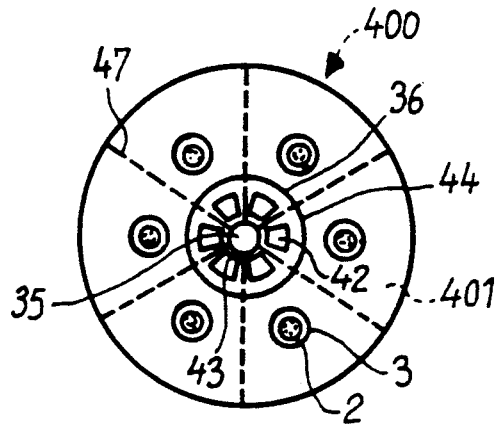
FIG. 4 shows a cross-section, along the axis BB' of FIG. 3, of the same klystron.
Figure 3:
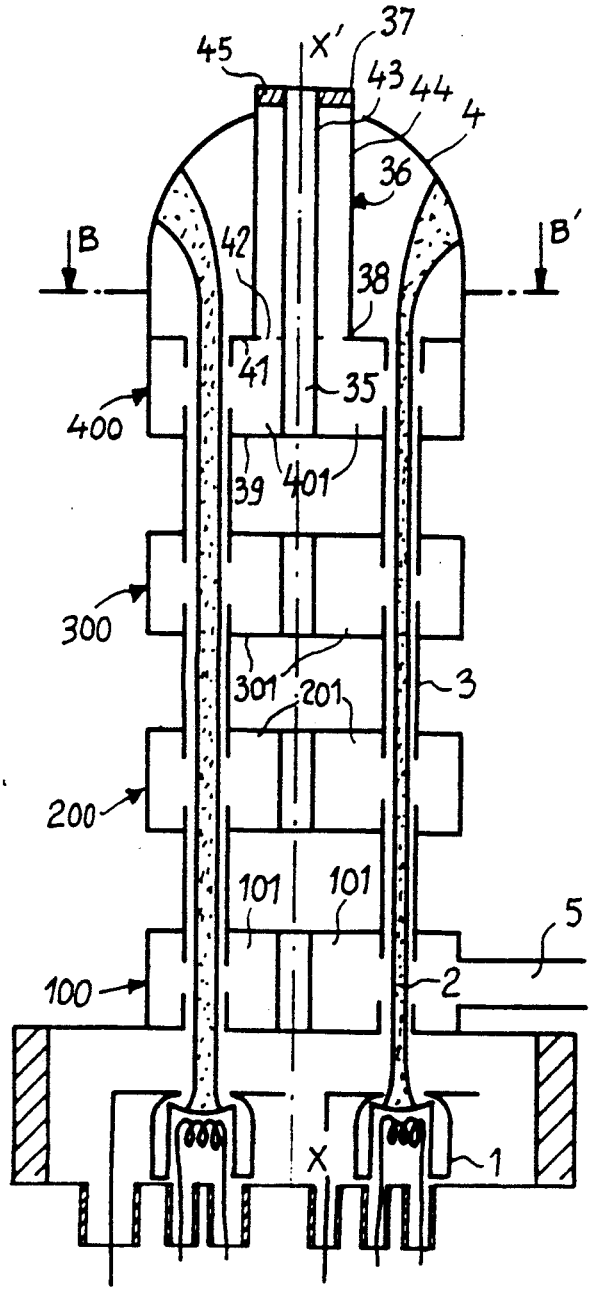
FIG. 3 shows a schematic view, in longitudinal section, of a variant of a multiple-beam klystron according to the invention.

FIGS. 3 and 4 show a variant of the klystron of FIGS. 1 and 2. The main difference between this klystron and the klystron of FIGS. 1 and 2 relates to the cavities 100, 200, 300, 400.

In FIGS. 3 and 4 each cavity 100, 200, 300, 400 respectively groups n adjacent secondary cavities 101, 201, 301, 401. Each beam 2 goes through a succession of secondary cavities 101, 201, 301, 401 and these secondary cavities belong to different cavities 100, 200, 300, 400.

The cavities 100, 200, 300, 400 have the shape of a ring and are centered on the axis XX'. A dead space 35 can be defined in the central hollowed-out part of the ring. This dead space is partially unused. The cavities 100, 200, 300, 400 are bounded by two walls 39, 41 placed so as to be facing each other, and positioned transversally with respect to the axis XX'. The beams 2 penetrate a cavity on the wall 39 side and come out on the wall 41 side.

The secondary cavities 101, 201, 301, 401 are obtained by means of radial walls 47 (see, FIG. 2) positioned within the ring, for example. Each secondary cavity 101, 201, 301, 401 has the shape of a ring sector. Preferably, the secondary cavities 101, 201, 301, 401 belonging to one and the same cavity 100, 200, 300, 400 will be electrically insulated from one another. They could also be coupled to one another by at least one aperture.

The cavities 100, 200, 300, 400 could have had the same shape as the one shown in FIGS. 1 and 2. The secondary cavities 101, 201, 301, 401 could have had the shape of a cylinder sector and there would have been no dead space.

The device designed to collect the microwave after amplification is formed by a transmission line 36. In FIGS. 3 and 4, it is a coaxial guide with an external conductor 44 and an internal conductor 43 which are concentric. Their axis is the same as the axis XX'. The coaxial guide 36 has one end 37 connected to the energy-using apparatus (not shown). As shown in FIG. 3, its other end 38 or base is connected to the klystron. The internal conductor 43 could extend the dead space 35. It could even be given substantially the same diameter to facilitate the mounting of the klystron.

Each secondary cavity 401 has at least one coupling aperture 42 located on the terminal wall 41 (see FIG. 1). This coupling aperture 41 opens out into the coaxial guide 36 between the internal conductor 43 and the external conductor 44.

FIG. 4 shows only one aperture 42 per secondary cavity 401. These apertures 42 are positioned on a ring centered on the axis XX'.

All that has been said about the collector 4 shown in FIG. 1 can be applied to the collector of figure 3.

This is also the case for the dimensional constraints on the coaxial guide 36 and for the windows which can be placed in the coaxial guide 36 or at the apertures 42. Only one window 45 (see FIG. 1) is shown in the coaxial guide 36.

The secondary cavities 101, 201, 301, 401 belonging to one and the same cavity 100, 200, 300, 400 are preferably identical and work in their dominant mode. The transmission line 36 will work in an optimum way if the secondary cavities 401 are excited in phase and with the same amplitude. To this end, the secondary cavities 101 are excited in phase and with the same amplitude. This excitation in phase gets transmitted to the other secondary cavities 201, 301, 401 step by step.

According to one variant, it is possible to envisage an arrangement where the secondary cavities 101, 201, 301, 401 are divided into compartments and group together several elementary cavities coupled to one another by at least one coupling aperture. Only one elementary cavity is crossed by an electron beam.

Figure 5:
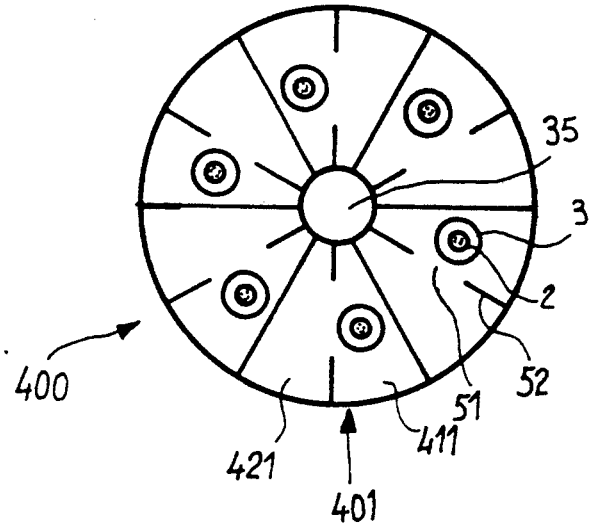
FIG. 5 shows a cross-section of a variant of the output cavity of a klystron according to the invention.

FIG. 5 shows a cross-section of the secondary cavities 401 of a klystron according to the invention. It is now assumed that the secondary cavities 401 each comprise two elementary cavities 411, 421 coupled to one another by a coupling aperture 51. Only one of the elementary cavities is crossed by an electron beam 2. This is the cavity 411. The coupling aperture 51 is positioned so that it goes through a radial wall 52 between the two elementary cavities 411, 421.

The present invention is not restricted to the examples described. Variants are possible, notably with respect to the shape of the cavities, the number and shape of elementary and secondary cavities and the positioning of the focusing device.

What is claimed is:

1. A microwave tube disposed around an axis XX' comprising: n, where n=an integer number greater than 1, means for providing n electron beams parallel to said axis XX', a succession of cavities aligned along the axis XX' including an input cavity and an output cavity, each beam respectively aligned to pass through the succession of cavities, means for applying an excitation signal in the input cavity, said excitation signal interacting with the n beams such that said n beams being the sole means for coupling said excitation signal to the succession of cavities, said output cavity having a terminal wall, a transmission line coaxial to said axis XX', and coupled to the output cavity through the terminal wall, a single collector coupled to the output cavity for collecting the n electron beams, wherein said collecting surrounds the transmission line and is coaxial with said transmission line.

2. A microwave tube according to claim 1, comprising at least one aperture in the terminal wall for coupling the transmission line to the output cavity.

3. A microwave tube according to claim 1 or 2, wherein the n electron beams are distributed in a circular configuration centered on the axis XX', the transmission line having a cross-section which is smaller than a surface defined by and within said circular configuration of said beams.

4. A microwave tube according to claim 3, wherein the transmission line is a circular waveguide.

5. A microwave tube according to claim 2, wherein the transmission line is a coaxial guide comprising an internal conductor and an external conductor and a base of said coaxial guide is joined to the terminal wall of said output cavity.

6. A microwave tube according to claim 5, wherein said aperture in the terminal wall is disposed between the internal conductor and the external conductor of said coaxial guide.

7. A microwave tube according to claim 1, wherein each cavity comprises n adjacent secondary cavities, with each electron beam crossing a corresponding secondary cavity in the succession of cavities.

8. A microwave tube according to claim 7, wherein each secondary cavity is further divided into a plurality of mutually coupled elementary cavities, only one of said elementary cavities being crossed by a corresponding electron beam.

9. A microwave tube according to claims 7 or 8, wherein each secondary cavity of the output cavity is coupled by at least one aperture to the transmission line.

10. A microwave tube according to claim 9, wherein the apertures are all distributed in a circular configuration centered on the axis XX'.

11. A microwave tube according to claim 7, wherein in each cavity, the adjacent secondary cavities are electrically isolated from one another.

12. A microwave tube according to claim 7, wherein in each respective cavity, the secondary cavities are directly coupled together.

13. A microwave tube according to claim 7, wherein in each respective cavity, the secondary cavities are substantially identical in shape and size and each works in a dominant electromagnetic mode.

14. A microwave tube according to claim 7, wherein in each respective cavity, the secondary cavities are electromagnetically excited in phase, by the excitation signal.

15. A microwave tube according to claim 7, wherein in each respective cavity, the secondary cavities are electromagnetically excited by the excitation signal with substantially a same amplitude signal.

* * * * *